United States Patent [19]

Kassen

[11] Patent Number: 4,955,609

[45] Date of Patent: Sep. 11, 1990

[54] GOLF CLUB WITH GREEN SURFACE REPAIR DEVICE

[76] Inventor: Albert D. Kassen, 4972 Barnstable La., Cincinnati, Ohio 45244

[21] Appl. No.: 401,836

[22] Filed: Sep. 1, 1989

[51] Int. Cl.[5] ..... A63B 53/00

[52] U.S. Cl. ..... 273/162 F; 273/162 E; 273/32 B

[58] Field of Search ..... 273/162 R, 162 A, 162 B, 273/162 C, 162 D, 162 E, 162 F, 32 R, 32 A, 32 B, 32 C, 32 D, 32 E

[56] References Cited

U.S. PATENT DOCUMENTS

| | | | |
|---|---|---|---|
| 1,520,113 | 12/1924 | Bloom | 273/162 A |
| 1,890,388 | 12/1932 | Kramlik | 273/162 C |
| 2,083,175 | 6/1937 | Werner . | |
| 2,154,989 | 4/1939 | Moore | 273/162 C |
| 3,185,483 | 5/1965 | Klynman . | |
| 3,360,807 | 1/1968 | Mauck . | |
| 3,456,737 | 7/1969 | Rhyme . | |
| 3,539,017 | 11/1970 | Johnson . | |
| 3,620,426 | 11/1971 | Hatch . | |
| 3,698,720 | 10/1972 | Gudmundsen | 273/162 E |
| 3,744,542 | 7/1973 | Stephens et al. . | |
| 3,774,913 | 11/1973 | Dien . | |
| 3,791,652 | 2/1974 | Schuler . | |
| 3,918,718 | 11/1975 | Billow . | |
| 3,977,674 | 8/1976 | Zeller . | |
| 4,239,216 | 12/1980 | Bauer . | |
| 4,241,917 | 12/1980 | Cohen | 273/162 C |
| 4,380,337 | 4/1983 | DiMatteo . | |
| 4,799,684 | 1/1989 | Rango . | |
| 4,854,592 | 8/1989 | Milovic | 273/162 E |

*Primary Examiner*—Edward M. Coven
*Assistant Examiner*—Raleigh W. Chiu
*Attorney, Agent, or Firm*—Wood, Herron & Evans

[57] ABSTRACT

A golf green repair tool comprises an extendible fork enclosed in a housing mounted directly on the grip or handle end of a golf club, preferably a putter. The fork is extendible from the housing where it is held by a detent mechanism in order to repair ball marks in the green. When the fork is extended, the club is inverted and grasped by the putter head for use in repairing the turf without the golfer's bending or stooping over. The tool is supported either as an integral grip of a new golf club, or as a replacement grip, or as a separable housing attached to a grip by appropriate securing means.

8 Claims, 2 Drawing Sheets

GOLF CLUB WITH GREEN SURFACE REPAIR DEVICE

BACKGROUND OF THE INVENTION

This invention relates to golf clubs in general, and more particularly to golf tools which are used to repair ball marks in putting greens.

When golf balls strike the green during play, they often leave surface irregularities, commonly known as ball marks. It is desirable that the putting green be free from surface irregularities so that putted balls run truly and are not diverted from their intended lines by the indentations or turf projections of such marks.

Tools for fixing ball marks in the green have long been available. For example, U.S. Pat. No. 3,360,807 describes a green repair tool composed of a fork which may be extended from its housing for use, then retracted and placed in the pocket of the golfer. In addition, U.S. Pat. No. 3,774,913 discloses a pronged tool mounted in the handle of a golf club and removable from the club when needed to repair the green. Such prior devices require that the golfer hold a small divot tool while stooping or bending over in order to lift and repair the ball mark. This is cumbersome for all golfers, particularly senior golfers. The small tools are easy to lose.

It is therefore an object of the invention to provide a ball mark repair tool that eliminates uncomfortable stooping and bending to repair ball and club marks in a green or elsewhere on the course as desired.

Another object of the invention is to provide a tool that is always handy and is so easy to use that it encourages golfers to repair ball marks and keep the greens in top condition.

SUMMARY OF THE INVENTION

In accordance with applicant's invention, a ball mark repairing tool comprises an extendible tool fork or similar structure mounted in a housing directly mounted to or integral with the handle end of a golf club, preferably a putter. Extention of the tool is achieved by pushing a button forwardly. The button is locked into place through the use of a detent. In use, the golfer extends the fork, inverts the club, grasps the putter head, and repairs the turf without bending or stooping over. The entire putter is thus converted into a ball mark repair tool for easily lifting and repairing ball marks in greens. The tool and its housing may either be manufactured integrally with the grip of the club, attached to the grip by an appropriate securing means, or formed as part of a substitute grip for use in re-gripping a club.

Accordingly, the invention provides a golf club easily convertible into a green repair took, as well as an improved grip used for converting a putter or other golf club into a green repair tool while retaining the original function of the club.

Further objects, features and advantages of this invention will become apparent from consideration of the following detailed description of a preferred embodiment of the invention and from the accompanying drawings in which:

DESCRIPTION OF THE PREFERRED EMBODIMENTS

Figure 1:
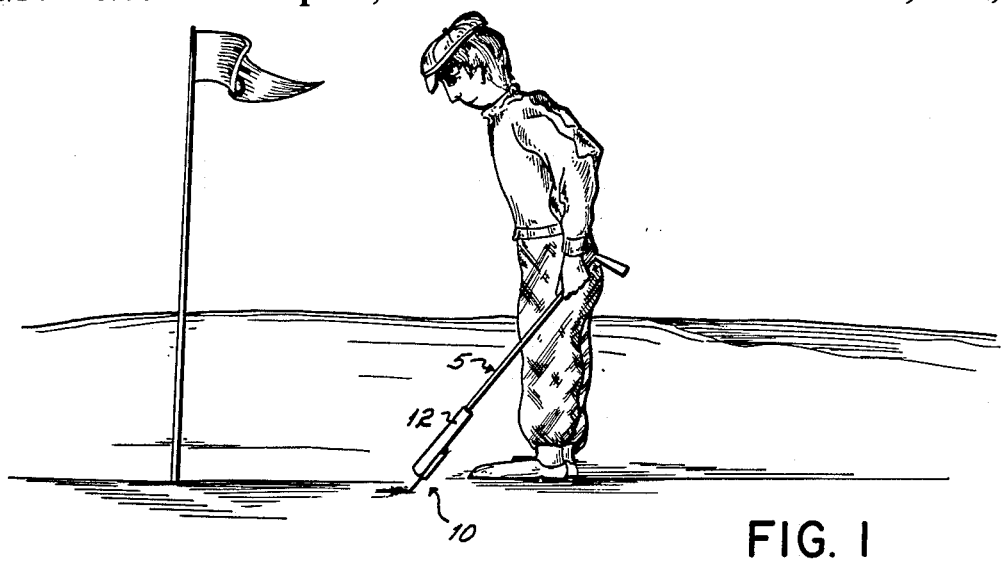
FIG. 1 shows a golfer utilizing a repair tool according to the invention to repair a ball mark in the surface of a putting green.

FIG. 1 shows a golfer utilizing a ball mark repair tool lift 10 to lift and repair a ball mark in the green. The repair or divot tool 10 is preferably attached to a putter 5 due to the fact that the putter is the club used while on the green and this keeps the tool in readiness for use.

Figure 2:
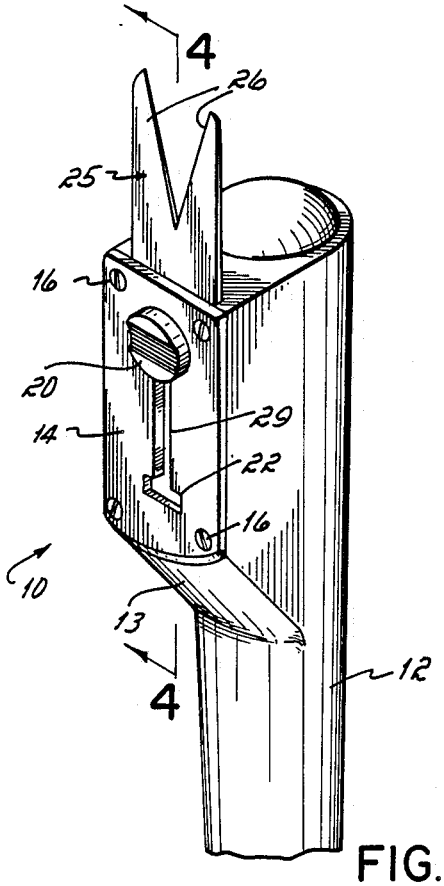
FIG. 2 is a partial perspective view of a golf club grip according to one embodiment of the invention having a tool formed integrally therewith and showing the fork in its extended position.
Figure 3:
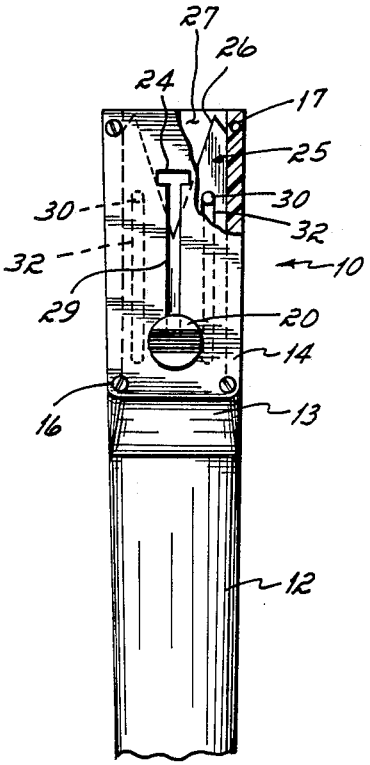
FIG. 3 is a front elevational view of the apparatus of FIG. 2 with the upper right portion thereof broken away and showing the fork divot tool is in a retracted position.
Figure 4:
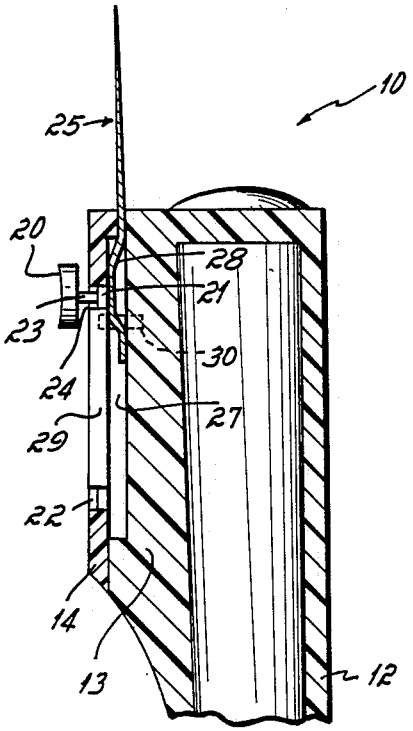
FIG. 4 is a cross-sectional view taken along lines 4—4 of FIG. 2.

FIGS. 2 through 4 illustrate one embodiment of the invention 10 which is integrally combined with the grip or handle 12 of a club or putter. The grip 12 is molded with an extended portion comprising a housing 13. A cover plate 14 is secured by screws 16, or other similar fasteners to the extended housing 13 at the threaded bores 17, and forms a cover over fork channel 27 in the housing. A fork 25 is extendibly disposed in channel 27 and preferably has two prongs 26 useful for insertion into the turf to lift and repair indented ball marks. The tool is not limited to two prongs and may be of any suitable configuration.

Fork 25 is provided with two elongated slits 32 Two fixed rivets or roll pins 30 extend from the floor of housing 13 into the slits and provide added stability for the fork while accommodating its extension and retraction.

A button 20 extends outwardly from the fork 25 through a slot 29 in plate 14. Slot 29 is about the same length as slits 32 in fork 25.

A detent mechanism permits extension of fork 25 and securement of the fork in the extended position for use. Preferably fork 25 is provided with or itself constitutes a concave portion or spring 28. A rectangular boss 21 is mounted on spring 28 and is sized to alternately fit in the rectangular recesses 22 and 24, disposed at opposite ends of slot 29 over fork channel 27. The rectangular boss 21 has a threaded bore (not shown) for receiving a threaded shank 23 of button 20. Longitudinal slot 29 is in communication with the fork channel 27 and permits the shank 23 of the button 20 to move along the direction of extension or retraction. The slot 29, however, is narrower than boss 21 and prevents it from passing outwardly of cover plate 14.

When the button 20 is pressed inwardly, the boss 21 is pushed out of one of the recesses 22, 24 into channel 27 so the button and fork 25 can be extended or retracted. Pressure of spring 28 urges the boss up into the recess when the fork 25 is extended or retracted to retain it in one of those positions.

For example, when the fork 25 is extended forwardly and button 20 released, the rectangular boss 21 is biased into rectangular recess 24, holding the fork in extended position. The spring 28 places an outward force upon the boss 21 thus locking the tool in its extended position, stabilized by pins 30, for use. The golfer may then turn the putter upside-down and grasp the putter head as a handle. The converted golf club is then used to lift and repair the ball mark in the green, as shown in FIG. 1.

Once the mark has been repaired, the golfer may retract the fork 25 into its housing by pressing the button 20 inward and sliding it rearwardly until the rectangular boss 21 is biased into rectangular recess 22. Of course, any suitable detent structure may be employed.

It will be appreciated that the housing 13 can be integrally formed with the club grip in a position which does not interfere with a normal putting grip and stroke. When formed integrally with a grip, the invention may be applied to new clubs or to old clubs as a replacement grip.

Figure 5:
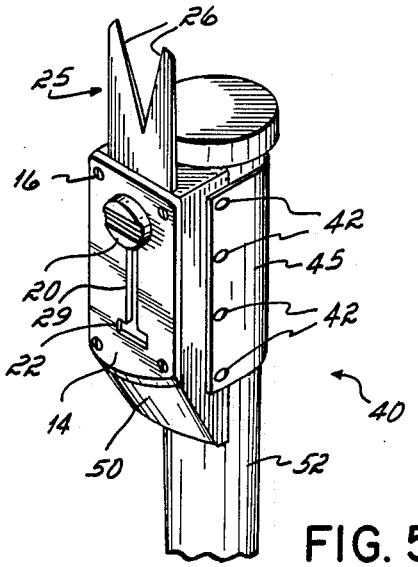
FIG. 5 is a perspective view of an alternate embodiment of the present invention with the fork tool and housing attached to the club grip by securing means.
Figure 6:
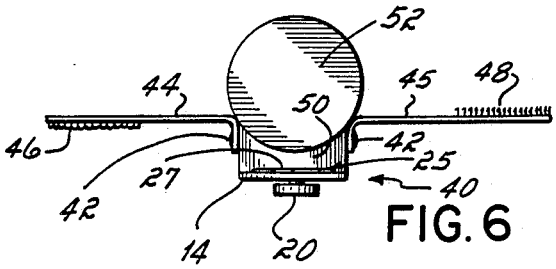
FIG. 6 is a top plan view of the tool of FIG. 5, illustrating the securing means in extended position.

FIGS. 5 and 6 illustrate an alternate embodiment of the tool, indicated generally at 40. In this embodiment, the tool is formed as an add-on device to a club or grip and is not formed integrally with the grip. In his embodiment, elements identical to those of the previously described embodiment will be designated with the same number.

The housing 50 is secured to a handle or grip 52 of a club by the use of hook and loop ("Velcro") fastening straps 44 and 45 extending from the housing 50.

For example, the outer side of strap 44 contains the loop pile component 46 while the inner side of strap 45 contains the mating or hook multiple component 48. The straps 44 and 45 are secured to housing 50 by the use of any suitable fasteners 42, or otherwise. By wrapping strap 44 around handle 52 first and then wrapping strap 45 on top of strap 44, the tool 40 is secured to the handle 52. Otherwise, its construction and operation is similar to the tool of FIGS. 1–4.

Of course, the tool 40 could be secured to the grip or handle 52 in any desired manner, however, the releasable construction permits the golfer to place it as desired, and the tool can be provided without need to re-grip the club.

What is claimed is:

1. A green repair tool comprising:

a golf club having a shaft, a grip at one end of said shaft, and a ball striking head at another end of said shaft;

a housing formed integrally with the grip of the golf club outside said shaft;

an extendible repair member disposed in said housing outside said shaft; and means for extending said member for use in repairing a green while attached to said club, and for retracting said member for storage within said housing.

2. The green repair tool of claim 1 wherein said means for extending and retracting said member includes:

a button secured to said member, a cover over said housing and having a slot therein, said button extending outwardly through said slot, a boss mounted on said button between said member and said cover, recess means on said cover at each end of said slot, means biasing said boss into one of said recess means when said member is extended or retracted to hold said member in an extended or retracted position.

3. The green repair tool of claim 1 wherein said head is disposed outwardly from said shaft and comprises a handle for said tool when said member is extended for use.

4. A green repairing tool for mounting on a golf club and comprising:

a housing;

a fork mounted with said housing and extendible therefrom for use in repairing a green;

straps attached to said housing, and means for securing said straps and said housing, on a grip of a golf club having a shaft in a position such that said fork can be extended from said housing and used in repairing a green while attached to said grip, with said housing disposed outside said shaft.

5. The green repairing tool of claim 4 further including means for extending and retracting said fork, said extending or retracting means including;

a button secured to said member, a cover over said housing having a slot therein, said button extending outwardly through said slot, a boss mounted on said button between said member and said cover, recess means on said cover at each end of said slot, means biasing said boss into one of said recess means when said member is extended or retracted to hold said member in an extended or retracted position.

6. A golf club grip for converting a golf club having a shaft and ball striking head into a dual function implement including a golf club and a green surface repair tool, said grip comprising;

an elongated grip tube having an opening therein for receiving the shaft of a golf club;

a housing formed on said grip outside said opening;

a selectively extensible green repair member disposed in said housing;

means for extending and retracting said tool member with respect to said housing, said tool remaining secured to said grip when extended for repairing a green surface.

7. The green repair tool of claim 6 wherein said means for extending and retracting said member includes:

a button secured to said member, a cover over said housing having a slot therein, said button extending outwardly through said slot, a boss mounted on said button between said member and said cover, recess means on said cover at each end of said slot, means biasing said boss into one of said recess means when said member is extended or retracted to hold said member in an extended or retracted position.

8. The green repair tool of claim 6 wherein said housing is formed integrally with the grip handle of a golf club having a shaft, and externally of said shaft.

* * * * *